United States Patent [19]

Bober et al.

[11] Patent Number: 4,775,572

[45] Date of Patent: Oct. 4, 1988

[54] EMBOSSED BINDING TAPE

[75] Inventors: Henry T. Bober, Fairport; Barbara A. Englant, West Webster, both of N.Y.

[73] Assignee: Xerox Corporation, Stamford, Conn.

[21] Appl. No.: 107,710

[22] Filed: Oct. 13, 1987

[51] Int. Cl.[4] ..... B42D 1/00

[52] U.S. Cl. ..... 428/163; 281/21 R; 428/167

[58] Field of Search ..... 428/156, 163, 167; 281/21 R

[56] References Cited

U.S. PATENT DOCUMENTS

| | | | |
|---|---|---|---|
| 1,897,038 | 2/1933 | Bohmert | 281/21 R |
| 2,116,008 | 5/1938 | Block | 428/163 |
| 2,294,347 | 8/1942 | Bauer et al. | 154/46 |
| 2,380,047 | 7/1945 | Hyman | 281/21 R |
| 2,523,860 | 9/1950 | Budden | 281/21 |
| 3,113,899 | 12/1963 | Hoag et al. | 156/273 |
| 3,152,921 | 10/1964 | Gallagher et al. | 428/167 |
| 3,258,385 | 6/1966 | Lake | 156/581 |
| 3,616,156 | 10/1971 | Scholl | 428/163 |
| 3,660,208 | 5/1972 | Hubbard | 156/571 |
| 3,847,718 | 11/1974 | Watson | 161/39 |
| 3,859,159 | 1/1975 | Carter et al. | 156/581 |
| 3,928,119 | 12/1975 | Sarring | 156/477 B |
| 4,139,699 | 2/1979 | Chang | 428/167 |
| 4,343,673 | 8/1982 | Smith, Jr. et al. | 156/583.4 |
| 4,371,195 | 2/1983 | Wang et al. | 281/21 R |
| 4,496,617 | 1/1985 | Parker | 281/21 R X |

*Primary Examiner*—Nancy A. B. Swisher

*Attorney, Agent, or Firm*—Frederick E. McMullen

[57] ABSTRACT

An adhesive binding tape consisting of a backing portion with temperature activated adhesive on one side, the exterior of the backing having alternating thick and thin sections extending along an axis substantially perpendicular to the longitudinal axis of the tape and forming alternating rows of peaks and valleys of generally rectangular cross section.

In a second embodiment, the peaks and valleys have a generally triangular cross section.

9 Claims, 3 Drawing Sheets

EMBOSSED BINDING TAPE

Figure 1:
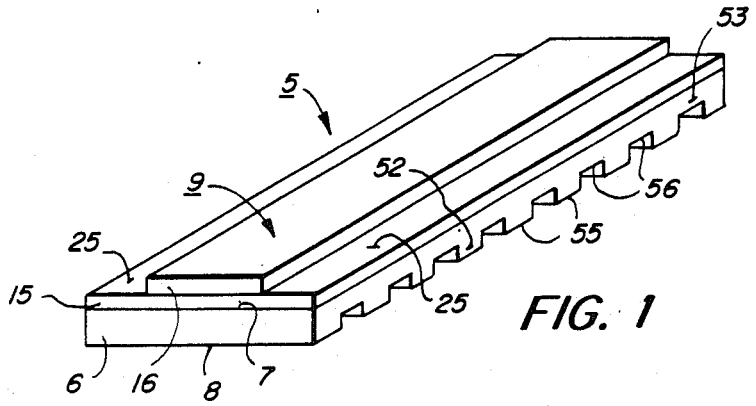

The invention relates to adhesive binding tapes of the type used to bind sheets together to form a book or pamphlet, and more particularly to an improved binding tape adapted to enhance distribution of the adhesive during the binding process while reducing pressure loads on the spine of the book or pamphlet being bound.

A number of ways, each with certain advantages and disadvantages, exist today for securing sheets together in the form of a book or pamphlet. These principally include stapling, stitching, sewing, and adhesive binding. In the case of adhesive binding, one popular, convenient, and relatively inexpensive way of adhesive binding is to use a binding tape having a heat activated adhesive thereon. In this type of binding, the binding tape, after being cut to an appropriate length, is heated to soften or melt the adhesive and then brought into pressure engagement with the assemblage of sheets to be bound. After an interval of time sufficient to allow the adhesive to attach to the sheets, pressure and heat are removed and the adhesive allowed to cool and form a bond. Following this, the bound book or pamphlet is removed.

A key factor in the success of this type of adhesive binding rests on the ability of the adhesive, once softened or melted, to flow and spread not only onto the edges of the sheets forming the book end or spine to which the tape is to be attached, but also into and between the sheets near the spine. If the adhesive can be adequately dispersed into and between the sheets, a much superior, stronger, and more permanent binding is achieved, greatly lessening the chance of sheets coming loose or falling out during subsequent use and handling of the book.

The prior art has considered many types and ways of performing adhesive binding, as for example, the sealing tape disclosed in U.S. Pat. No. 2,294,347 to Bauer et al, in which a paper backing has stripes of moisture activated adhesive thereon. Or U.S. Pat. No. 2,523,860 to Budden in which the adhesive is applied directly to the spine of the book being bound by means of a wheel, the surface of the wheel being shaped so as to apply the adhesive to the spine in a pattern. U.S. Pat. Nos. 3,113,899 to Hoag et al and 3,258,385 to Lake disclose arrangements for sealing thermoplastic films where the surface of the sealing element has a ribbed, pyramidal, or other shape intended to facilitate sealing. Similarly, U.S. Pat. No. 3,859,159 to Carter et al discusses the formation of rupturable seals using a heated die, the die surface having a chevron pattern, while U.S. Pat. No. 4,343,673 to Smith, Jr. et al discloses a system for binding copy sheets in which the xerographic toner serves as the adhesive and heated pressure shoes, one of which has a ribbed surface, are used to fuse the toner during the binding process. And, U.S. Pat. No. 3,660,208 to Hubbard, discloses a labeling wheel for applying address bearing labels to envelopes, the wheel having a series of vacuum cross slots in the surface thereof through which vacuum is admitted for the purpose of temporarily attaching the label to the wheel so that the label can be transported to the envelope.

In contrast to the above, the present invention provides an adhesive binding tape for use in binding articles such as books, pamphlets, and the like comprising: a contact portion adapted to engage the spine of the article, the contact portion comprising a heat sensitive adhesive covering at least a part of the surface of the backing portion facing the spine of the article, and a backing portion against which heat and pressure is applied to bring the tape into pressure contact with the spine of the article to be bound while melting and softening the adhesive, the backing portion having an uneven exterior forming a series of peaks and valleys so that relatively high localized pressure points are developed at the peaks so the peaks are compressed by the pressure, the localized pressure points enhancing fluid flow and penetration of the adhesive into the book spine whereby to avoid the need to apply high pressure over the entire spine.

IN THE DRAWINGS

Figure 3:
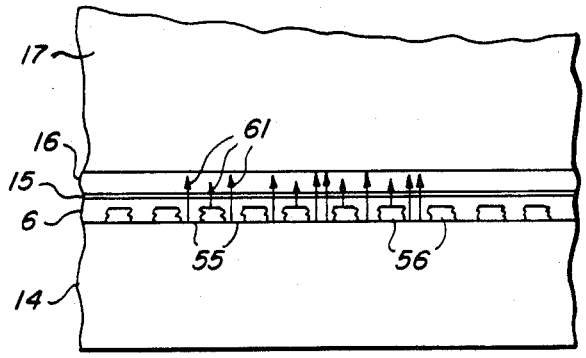
Figure 4:
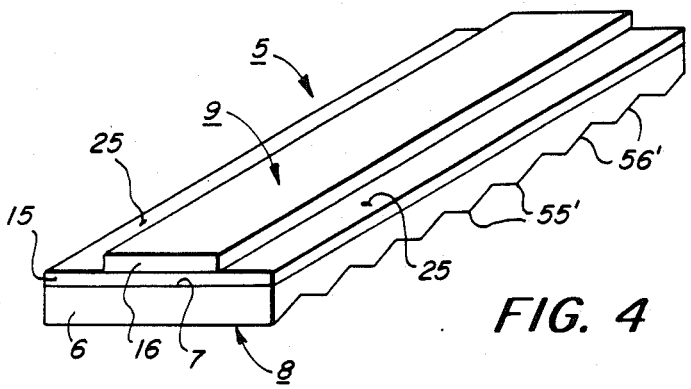

FIG. 1 is an isometric view of the improved adhesive binding tape of the present invention in which the outer surface of the tape has successive rows of peaks and valleys therein to provide areas of high and low pressure respectively for enhancing the distribution of adhesive during binding and reducing spine pressure loads;

FIGS. *2a* and *2b* are schematic views depicting an exemplary binding apparatus for applying the binding tape of FIG. 1 to the spine of an article such as a book or pamphlet;

FIG. 3 is an enlarged view in cross section illustrating the advantageous pressure distribution achieved by the binding tape shown in FIG. 1 during the binding process; and FIG. 4 is an isometric view of an alternative binding tape in which the peaks and valleys are generally triangular in cross sectional shape.

Referring to FIG. 1, there is shown the adhesive binding tape or strip, designated generally by the number 5, of the present invention. Tape 5 comprises a backing 6, one side 7 of which bears a suitable heat activated adhesive 9. Backing 6 may comprise any suitable backing material such as paper, fabric, mesh, metal, plastic, or the like. Normally, backing 6 is composed of a relatively flexible material.

The adhesive type and arrangement shown as an example is that disclosed in U.S. Pat. No. 3,847,718 to Watson, incorporated by reference herein. There, a layer 15 of low tack adhesive material covers side 7 of backing 6 with a central strip 16 of high tack adhesive material thereon flanked by exposed low tack adhesive flaps 25. The width of the stripe 16 is substantially equal to the width of the article to be bound. Other adhesive types and arrangements including a single layer of adhesive rather than the multiple layers shown in the example may, however, be envisioned.

Referring now to FIGS. *2a* and *2b*, tape 5 is normally applied to the spine 18 of the article to be bound, which typically comprises a collection or stack of sheets or pages 17 assembled together in the form of a book, pamphlet or other article 24. There, an exemplary binding apparatus 20 for applying a length of tape 5 to the stack of sheets 17 is shown, binding apparatus 20 having a drive motor 37 for rotating a series of cams 39, 43, 45, 48. Cams 39, 43, 45, 48 actuate a pair of clamps 27, 27a to clamp the sheets 17, retract a support 21, carry the spine end 18 of the sheets 17 against the tape 5, and then engage the assembled sheets and tape with heated side platens 12, 13 and base 14 for a preset interval of time during which the adhesive is softened and fixed to secure the sheets together and the tape to the spine and lower sides to form a book. A more complete description of the binding apparatus is found in U.S. Pat. No.

Figure 2A:
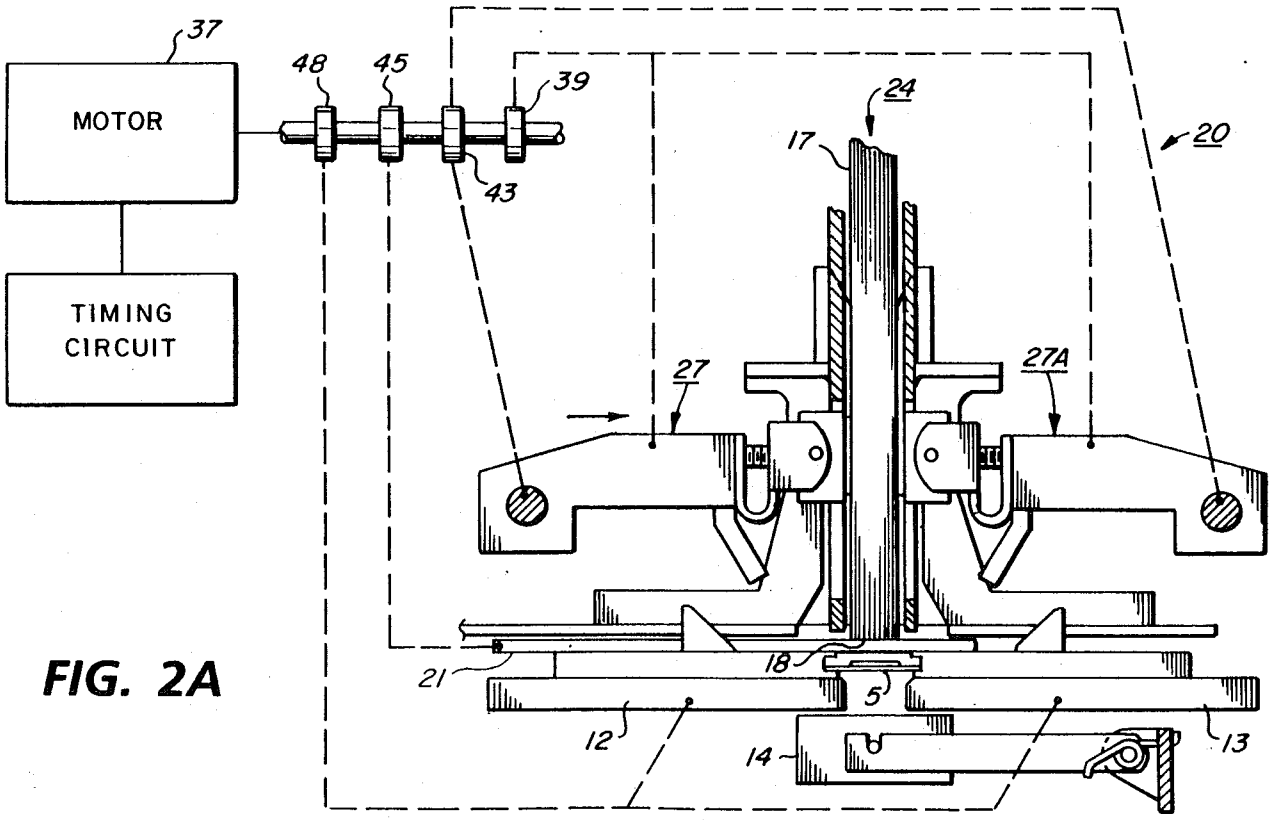
Figure 2B:
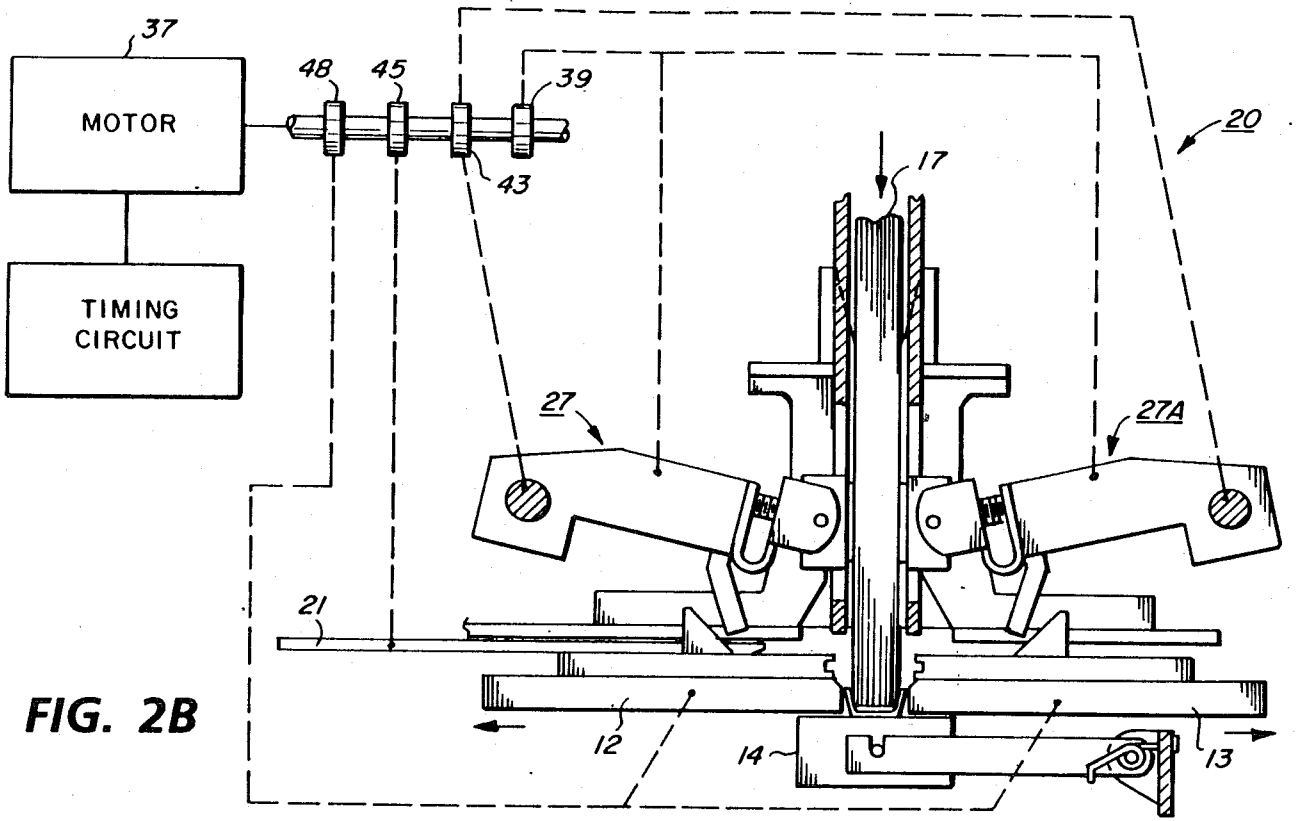

3,928,119 in the name of Ernest J. Sarring, incorporated by reference herein. Binding apparatus different from that described above and shown in FIGS. 2*a* and 2*b* of the drawings may, however, be envisioned.

In this connection, it will be understood that the length and width of the binding tape are chosen to provide the desired type of binding. Referring to FIG. 1 of the drawings, normally, tape 5 has a length substantially equal to the length of the article 24 while the width of tape 5 is preferably slightly larger than the thickness of the article to provide flaps 25 that wrap around the corners and partially up the sides of the article 24.

Binding tape 5 may be chosen from a stock of various width tapes pre-cut to various standard sizes. Alternately, the tape may be cut to the desired length at the time of binding. In the case of the latter, tape 5 may be supplied in the form of an endless reel or roll with suitable tape cutting means (not shown) provided as part of binding apparatus 20 for cutting the tape to desired length.

In order to enhance the effectiveness of the binding process and the bind that is achieved and reduce pressure loads on the article spine, binding tape 5 of the present invention is designed to generate, during the binding process, discrete or localized areas of high pressure which enhance thermal penetration and the flow of the softened or melted adhesive into and between the sheets 17 at the book spine 18. For this purpose, tape backing 6 is formed with alternating thick and thin sections 52, 53 respectively, such sections forming an uneven or corrugated type exterior 8 on tape backing 6. The side 7 of tape backing 6 which supports adhesive 9 is smooth.

In the preferred embodiment shown in FIG. 1, the longitudinal axis of sections 52, 53 extend in rows perpendicular to the longitudinal axis of tape 5, with sections 52, 53 extending across the width of the backing 6. In this embodiment, sections 52, 53 comprise alternating rows of protuberances or peaks 55 separated by rows of recesses or valleys 56 therebetween, peaks 55 and valleys 56 having a generally rectangular shape when seen in cross section. While various size peaks and valleys 55, 56 may be contemplated, peaks and valleys 55, 56 having a width w of approximately 2–4 mm and a height-/depth relationship h of approximately ½–1 and ½ mm would be suitable. Other dimensional relationships may, however, be envisioned.

Referring particularly to FIG. 3, during the binding process, the binding pressure provided by base 14 of binding apparatus 20 develops localized pressure points in the areas opposite peaks 55. The force applied by base 14 to the spine 18 of the stack of pages 17 tends to compress or flatten peaks 55, creating a series of spaced parallel line-like points of higher pressure extending across the width of tape 5 in the areas generally opposite each of the peaks 55. These localized pressure points are designated generally by the arrows 61 in FIG. 3. This localization of pressure points has the advantage of creating better fluid flow or penetration of the melted adhesive in between the sheets 17 without the high spine loads that would otherwise be needed to apply the same pressure over the entire spine. Higher pressure spine loads as will be understood, require better, i.e., closer to the edge, support of the spine and thus can constrain design options and increase cost. In addition, the valley areas 56 allow an in-between and controlled residual spine adhesive layer to remain. This feature is important for spine flex strength. As a result, an enhanced bind is achieved.

In the embodiment shown in FIG. 4 of the drawings where like numerals refer to like parts, the rows of peaks and valleys 55′, 56′ are generally triangular in shape when viewed in cross section.

While rows 55, 56 and 55′, 56′ are described and illustrated as extending in a direction substantially perpendicular to the longitudinal axis of tape 5, rows 55, 56 and 55′, 56′ may be provided at an angle to the longitudinal axis. Alternatly, rows 55, 56 and 55′, 56′ may be curved, as for example, sinusoidal.

While the invention has been described with reference to the structure disclosed, it is not confined to the details set forth, but is intended to cover such modifications or changes as may come within the scope of the following claims.

We claim:

1. An adhesive book spine binding tape for use in binding pages together to form a book, said pages when assembled together having one end forming a spine, comprising:

(a) a contact portion adapted to engage said spine, the contact portion comprising a heat sensitive adhesive covering at least a part of the surface of the backing portion facing said spine, and (b) a backing portion against which heat and pressure is applied to bring the tape into pressure contact with said spine while melting and softening said adhesive, the backing portion having an uneven exterior forming a series of peaks and valleys so that relatively high localized pressure points are developed at said peaks as said peaks are compressed by said pressure, said localized pressure points enhancing fluid flow and penetration of said adhesive into said spine whereby to avoid the need to apply high pressure over the entire spine.

2. The binding tape according to claim 1 in which said peaks and valleys extend generally perpendicular to the longitudinal axis of said tape along said backing portion.

3. The binding tape according to claim 2 in which said peaks and valleys comprise rectangular shaped projections and depressions.

4. The binding tape according to claim 2 in which said peaks and valleys comprise triangular shaped projections and depressions.

5. The binding tape according to claim 2 in which said peaks and valleys follow a sinusoidal path, said peaks and valleys being in parallel relation with one another.

6. An adhesive book spine binding strip for use in edge binding sheets together to form a book, said sheets when assembled together having one end forming a spine comprising:

(a) a tape forming a backing for adhesive, and (b) a temperature responsive adhesive on the side of said tape adapted for contact with the spine of said sheets to be bound, (c) said tape being formed with a plurality of thick and thin sections extending along an axis substantially perpendicular to the longitudinal axis of said tape so that on exposure of said tape exterior to heat and pressure during binding, said adhesive is actuated, and said tape pressed against the spine of said sheets whereby there is created alternate high and low line like areas of pressure extending along an axis substantially perpendicular to the longitudinal axis of said tape substantially opposite said thick and thin tape sections, said high pressure areas forcing said adhesive into enhanced contact with the spine of said sheets to enhance fluid flow and penetration of melted adhesive in between said sheets while reducing spine pressure loading.

7. The binding strip according to claim 6 in which said tape exterior is uneven with alternate high and low surface undulations extending along an axis substantially perpendicular to the longitudinal axis of said tape.

8. The binding strip according to claim 6 in which said high and low sections are rectangular in cross section.

9. The binding strip according to claim 6 in which said high and low sections are triangular in cross section.

* * * * *